United States Patent [19]

Aggio

[11] 4,201,301

[45] May 6, 1980

[54] CONTAINER FOR THE TRANSPORT OR STORAGE OF FOOD, PARTICULARLY PIZZA

[76] Inventor: Giordano Aggio, 163/1, Via S. Faustino, 41100 Modena, Italy

[21] Appl. No.: 20,473

[22] Filed: Mar. 14, 1979

[30] Foreign Application Priority Data

Mar. 14, 1978 [IT] Italy ..... 40040 A/78

[51] Int. Cl.[2] ..... B65D 21/00; B65D 85/72; B65D 102/26

[52] U.S. Cl. ..... 206/507; 229/2.5

[58] Field of Search ..... 229/2.5; 206/507, 505, 206/596

[56] References Cited

U.S. PATENT DOCUMENTS

| | | | |
|---|---|---|---|
| 1,945,397 | 1/1934 | Gray | 229/2.5 R |
| 2,296,808 | 9/1942 | Chaplin | 229/2.5 R |
| 2,814,427 | 11/1957 | Emery | 229/2.5 R |
| 2,873,782 | 2/1959 | Gunn | 229/2.5 R UX |
| 3,027,045 | 3/1962 | Wilson | 206/505 |
| 3,049,265 | 8/1962 | Van Moss, Jr. et al. | 206/596 |
| 3,083,888 | 4/1963 | Miller | 229/2.5 R X |
| 3,286,144 | 8/1966 | Gaunt | 229/2.5 R |
| 3,307,739 | 3/1967 | Cloyd et al. | 229/2.5 R X |
| 3,351,265 | 11/1967 | Miller | 229/2.5 R |
| 3,759,416 | 9/1973 | Constantine | 206/505 |
| 3,786,982 | 1/1974 | Rakes | 229/2.5 R |
| 3,933,295 | 1/1976 | Congleton | 229/2.5 R |

FOREIGN PATENT DOCUMENTS

| | | | |
|---|---|---|---|
| 1379236 | 10/1964 | France | 206/507 |
| 901817 | 7/1962 | United Kingdom | 206/507 |
| 1030944 | 5/1966 | United Kingdom | 206/505 |
| 1243387 | 8/1971 | United Kingdom | 206/505 |

*Primary Examiner*—Davis T. Moorhead

*Attorney, Agent, or Firm*—Browdy and Neimark

[57] ABSTRACT

Container for the transport and consumption of pizza and food in general, consisting of a cover equipped with a small peripheral step (5) of same cover under the upper level (7) of the rim (8); this step is interrupted at constant angular intervals by niches (9) tapered towards the bottom, which end at the bottom of the container; these niches are intercalated with analogous niches (14) of inferior depth compared to that of the niches (9), limited by the level (13) and of such dimensions that they consent the outer walls of the niches (9) to fit into the inner part of the niches (14): the step (5) and the niches (9, 14) are protruding towards the outside compared with the walls (4) of the cover.

Once arranged the food at the inside of the container, it is possible to place a lid (17) on it, the projections (18) of which come to lean on the bottom levels (13) of the niches (14), or it is possible to place another container on it, resting the bottom of the niches (9) on the levels (13) a.s.o.

When empty, the containers fit closely into each other with a minimum of encumberment as to height, as their niches (9) are in correspondence.

9 Claims, 7 Drawing Figures

CONTAINER FOR THE TRANSPORT OR STORAGE OF FOOD, PARTICULARLY PIZZA

The invention concerns a container for the transport and consumption of pizza and food in general, that is to say a wrapping for the transport of foodstuffs, particularly if cooked, mainly such as pizza, cakes, meat, vegetables, noodles and others from the purchase place to the place of consumption as, for instance and not in a limitative sense, from the pizzeria or self-service or grillroom to one's home or office; these containers can also serve for the consumption of said foodstuffs without need of plates or dishes.

The prior state of art foresees the transport of pizza and food by means of accidental cardboard or plastic wrappings or in tinfoil or traditional plates.

This prior state of art is liable to further improvement with regard to the necessity, on one hand not to contaminate the upper surface of the food with paper, cardboard or tin-foil in order to protect it from the environment, on the other hand, to have a possibility of transporting the food in a very stable way, thus avoiding to have to use a traditional plate as cover and, above all, to have to transport heaps of instable or yielding plates in case of more than one portion in a pile, which might lead to the downfall of the pile or to antihygienic contacts and/or soiling.

From the aforesaid, results the necessity of resolving the technical problem of finding a container for the transport of pizza and foodstuffs in general; such a container has to be stable, even in case of multiple transport, suitable to protect the contents hygienically from the environment and to separate the contents of the superimposed containers perfectly in such a way that the contact between the various contents as well as with other materials is avoided.

Moreover, such a container has to be very economical so that it can be thrown away after its use, it must also serve for the consumption of the transported product and it must present a minimum encumberment, when stacked in an empty state.

The invention resolves the above technical problem by adopting a container, preferably manufacturable of vacuum-formed plastic material, which is equipped with a moulded rim and of a shape that becomes narrower towards its bottom, the whole serving for the stacking of one or more containers in an empty state with a minimum of encumberment in height as well as the piling of full containers; it is principally foreseen that said container is peripherally equipped with niches growing narrower towards their lower part up to the bottom and protruding towards the outside of the base perimeter of the container at angular intervals of constant width; these niches have their origin at the upper level of the container rim and in the middle of each couple of said niches there is foreseen another one of lesser depth, which has its origin under said upper level. The latter niche has its bottom at a higher level than that of the bottom of the container itself, of the same or bigger quantity that the thickness of the pizza or, at any rate, than the maximum thickness of the food layer.

The straight section of said latter niche is of the same shape as the straight section of the deeper niche with dimensions and radial position such as to consent the projecting outer bottom part of said deeper niche to fit into the inside of said less deep niche.

A peripheral inner step of the container, interrupted by said niches, permits the bottom of the deeper niches of the container to lean on this step before fitting into the less deep niches at any relative angular position different from that of the fitting in.

The advantages obtained by this invention are: stable transport, that is to say without possibility of sideways gliding or overturning of the piled containers, a perfect separation of the contents of each container from that of the others being part of the same pile, the nearly complete isolation of the food from the outer environment, the non-contamination of the food by parts of foreign matters serving to cover it, the possibility to use the container also for the consumption of the food and finally, the possibility to stack more than one empty container with a minimum encumberment in height.

One way of realizing the invention is illustrated, purely as an example, in the seven enclosed designs, where:

Figure 1:
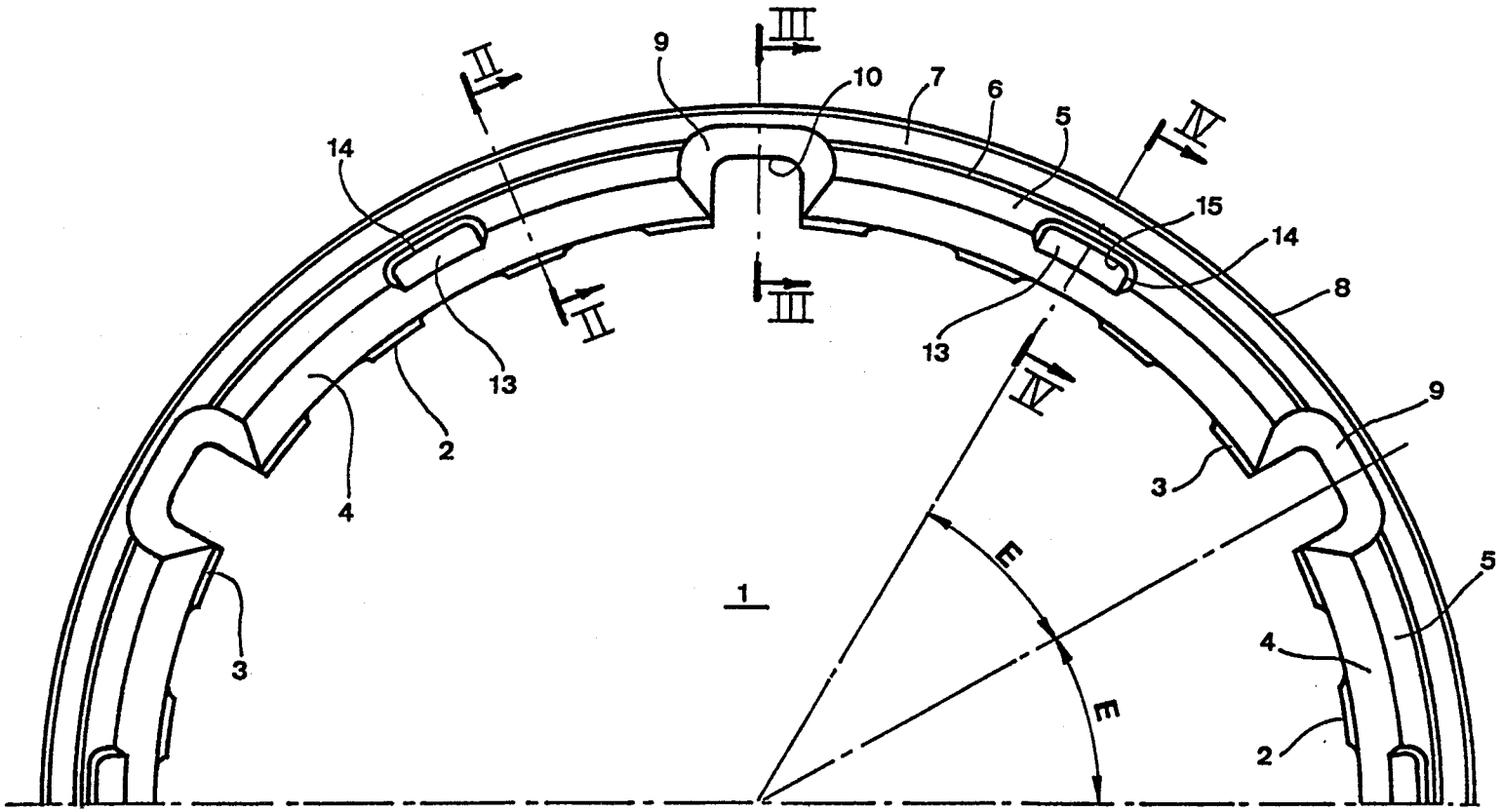
FIG. 1 is a plan view of a half container, the other half being specularly symmetrical.
Figure 2:
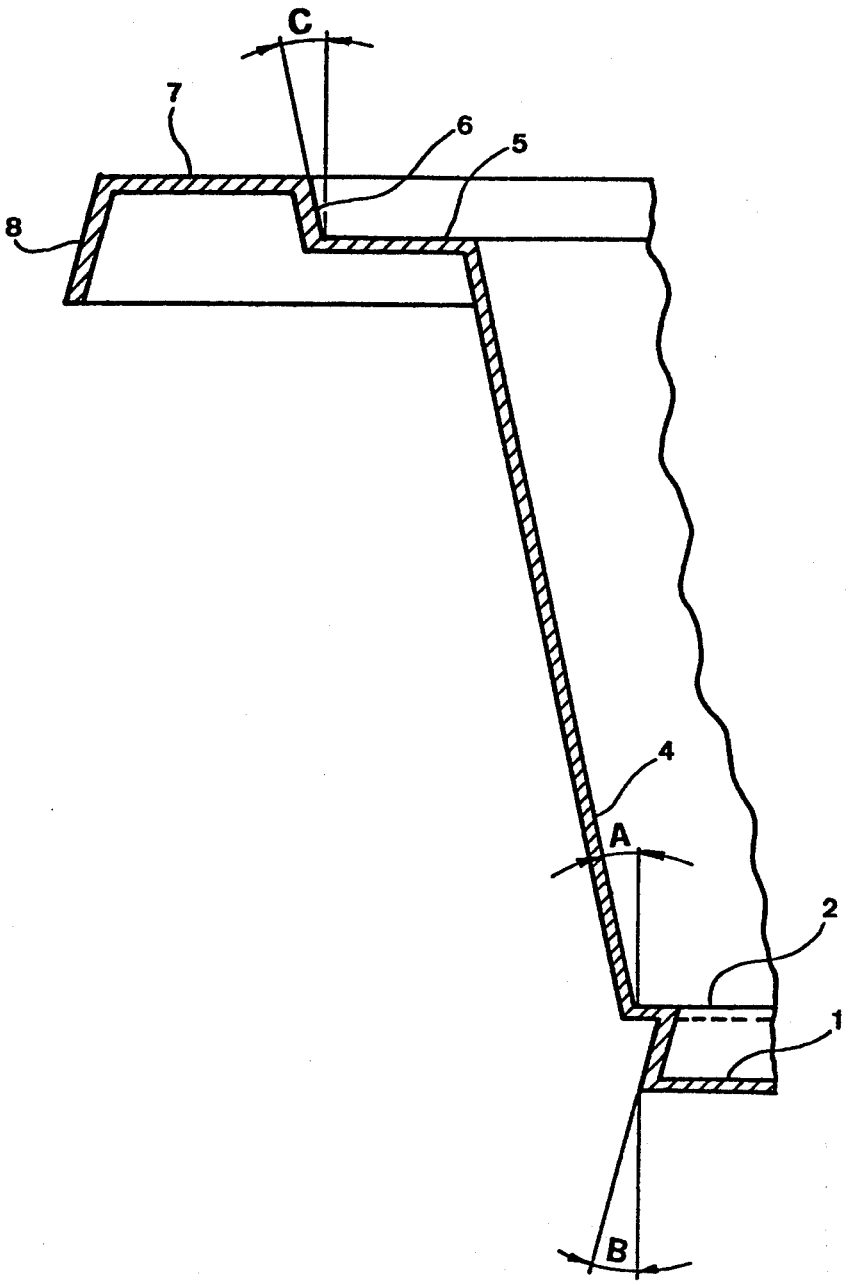
FIG. 2 is a blown up partial section II—II of FIG. 1.
Figure 3:
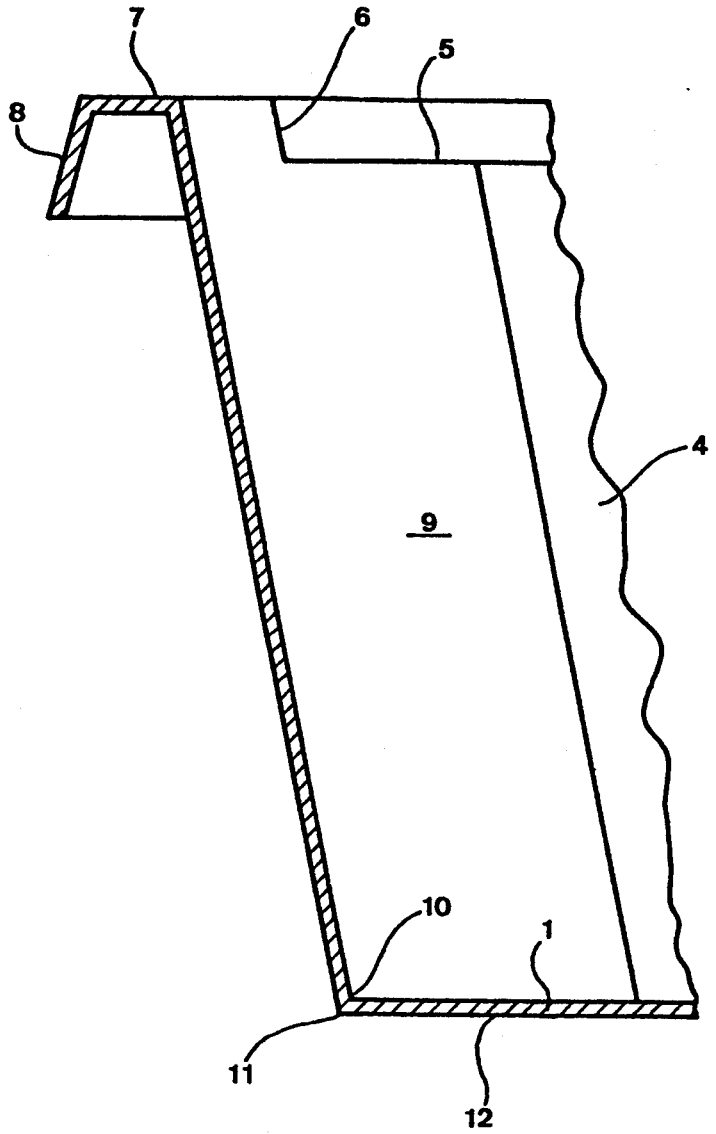
FIG. 3 is a blown up partial section III—III of FIG. 1.
Figure 4:
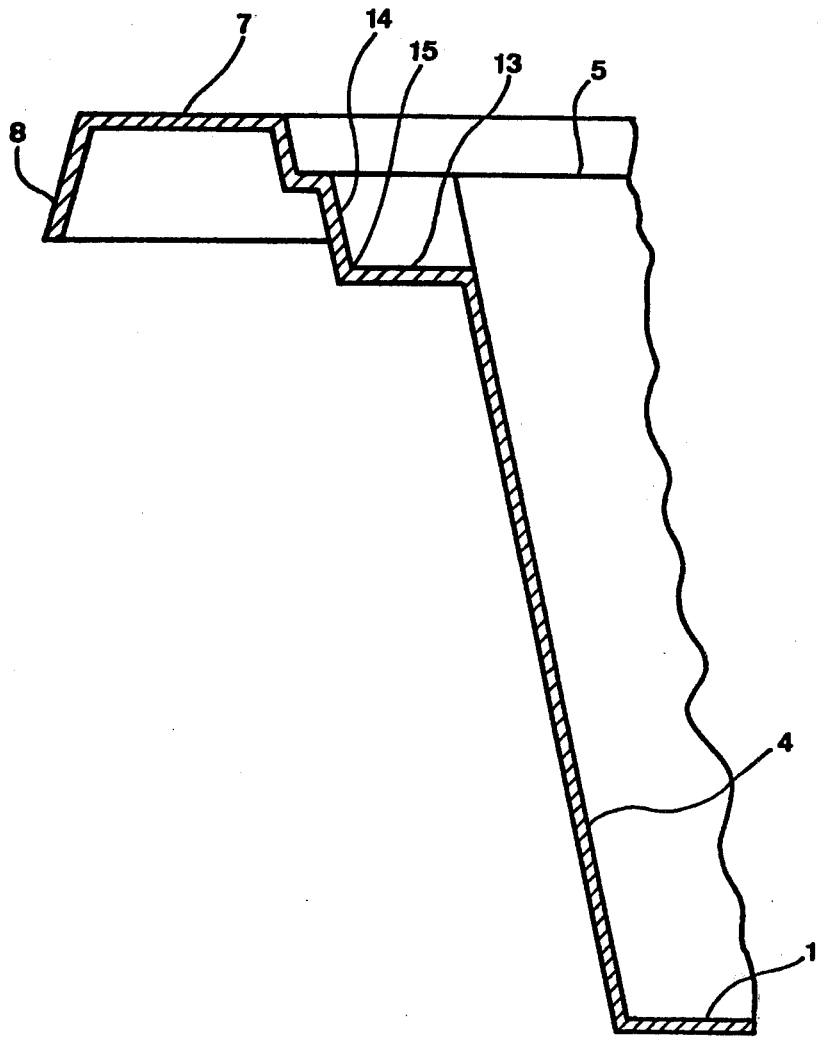
FIG. 4 is a blown up partial section IV—IV of FIG. 1.

The indications are as follows: 1 is the inner bottom level of the container equipped with sectors 2 projecting towards the inside, the upper level of which 3 forms a small peripheral inner step, of the type already known for plastic cups, interrupted at various sections and positioned above the bottom 1 at a distance of f.i. 2 or 3 mm so that the peripheral outer rim of the immediately following container can lean on it, when empty containers are piled with a minimum of encumberment; 4 indicates the truncated cone wall or cover body forming the container intended to hold the foodstuff; 5 indicates a peripheral upper step interrupted in various areas and forming, as a whole, a support for the upper container before the transport; 6 indicates a truncated cone wall for the connection of the step 5 and the level 7 forming the upper limit of the container; 8 indicates a peripheral truncated cone rim at the outside, serving as a grip and as a stiffener directed towards the bottom, which couples with those of the other containers, when they are superimposed in an empty state; the depth of the container, that is to say the distance between the level 3 and the upper level of the step 5 can greatly differ, f.i. at an interval of approximately between 1 and 5 cms, or more, when this is necessary; the depth of the level 5 compared to that of the level 7 can be co-ordinated with the existing one between levels 3 and 1 in such a way that the leaning of the container on the bottom step 2–3 is guaranteed, when stacked in an empty state, guaranteeing at the same time the minimum depth of level 5 compared to level 7; 9 indicates sector niches flared towards the top, to the interior rim 10 of which situated on the inner bottom level 1, corresponds (FIG. 3) the outer rim 11 of the lower level or of the outer bottom level 12; each of said niches determines a projection with straight section of C shape compared to the outer peripheral bottom rim of the plate; 13 indicates the sector support levels obtained under the level 5 by means of niche 14 flared towards the top and with straight section of C or U shape similar to that of niche 9, said niche 14 being less deep than niche 9; to the lower rim 15 of this niche 9 fits with clearance the lower rim 11 corresponding to the lower rim 10 of the niche 9 during the transport of the food; 16 indicates the pizza, 17 the lid equipped with protruding sectors 18 to be fitted into the niches 13-14-15, whereas the upper part of the niches 9 remain partially uncovered, that is as much as is needed to introduce a fingernail into them to facilitate the extraction of the lid; it is moreover foreseen to replace the lid 17 by an empty container, which covers the opening of said niche completely with its bottom, wherever it is necessary to isolate the container totally from the outside environment; as to the angles A,B,C,D,E, these may be largely different and—to give an example—have approximately the following values:

A=(FIG. 2) 4°+20°
B=(FIG. 2) 10°+20°
C=(FIG. 2) 4°+20°
D=(FIG. 6) 4°+20°
E=(FIG. 1) 15°+90°

Figure 5:
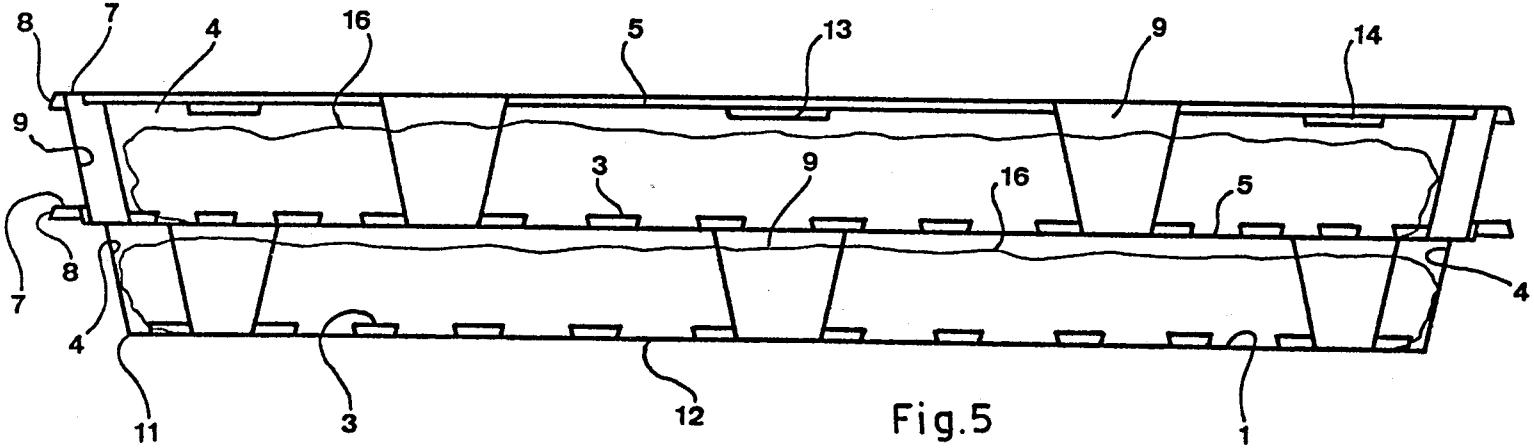
FIG. 5 is a schematic vertical section of two superimposed containers holding one pizza each and fitted one into the other; the upper pizza is protected from contact with the environment by means of a cardboard or plastic disc fitted into the support notches of the upper container.
Figure 6:
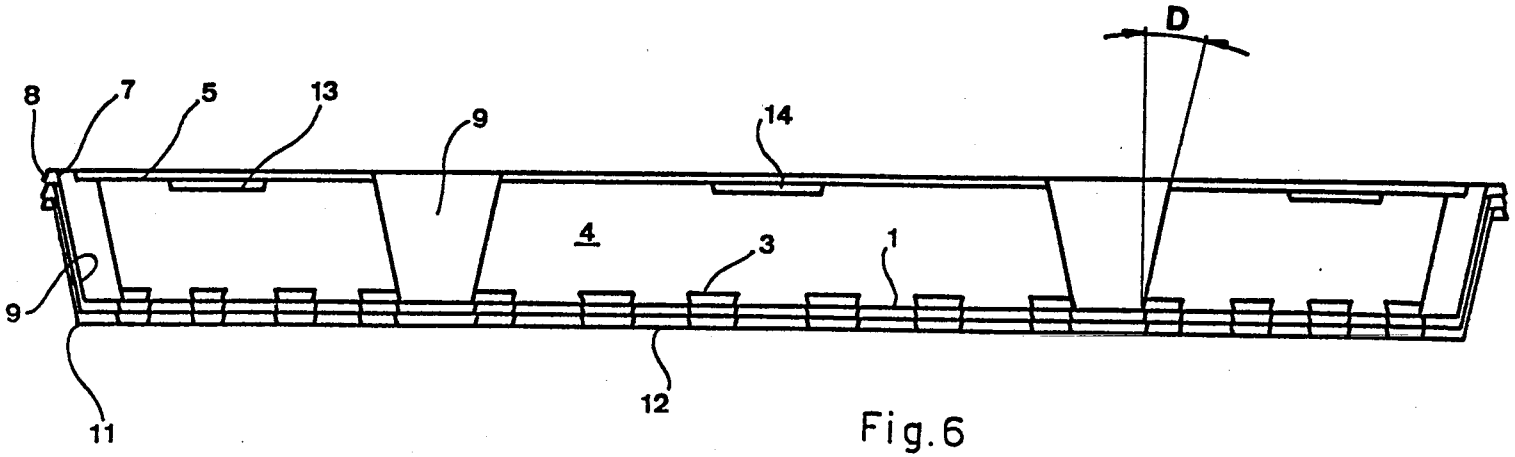
FIG. 6 is a schematic vertical section of the stacking of empty containers.
Figure 7:
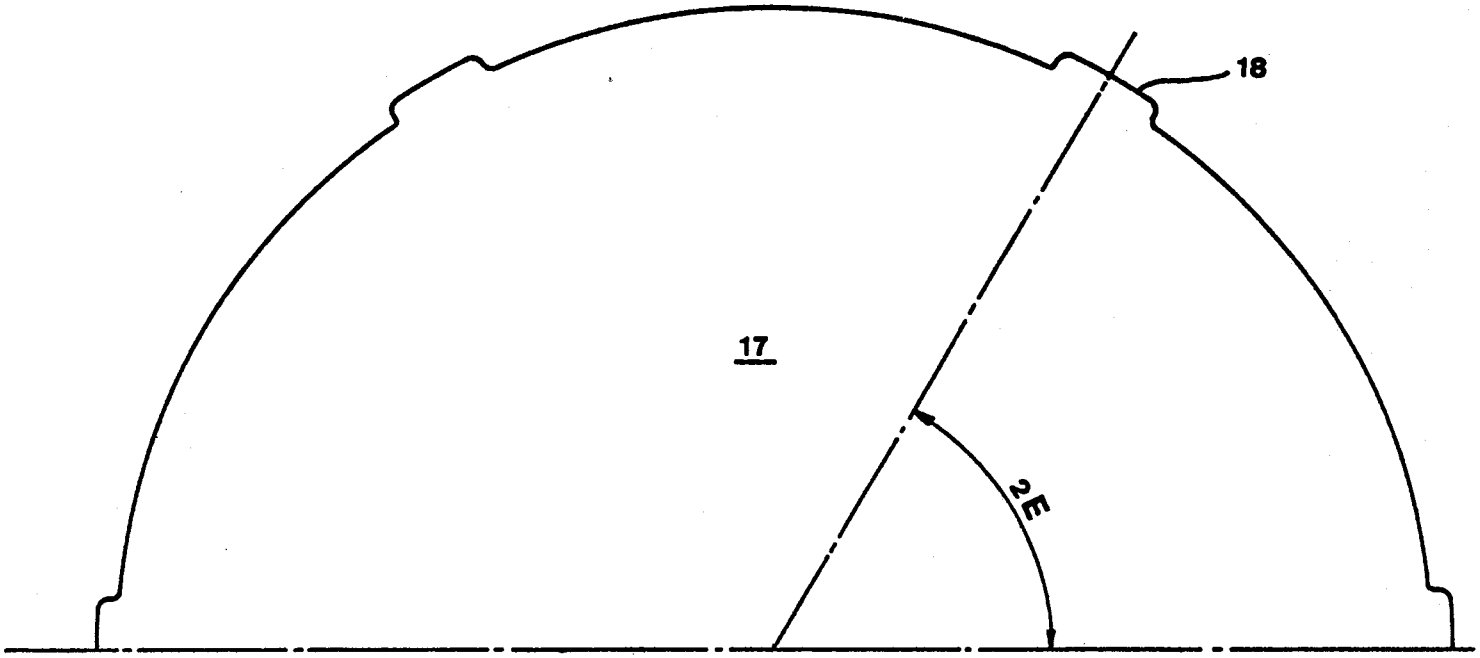
FIG. 7 is the plan of the fitted lid.

The invention is used in the following way: once extracted the container from the pile of FIG. 6, be acting with fingernail or with finger or with a blade under the rim 8, one introduces the pizza, covering it with another identical container, which must be shifted by an angle E compared to the lower one, or with a lid 18; in the first case the rim 11 corresponding to the lower rim 10 of each niche 9 couples with rotatory clearance with the rim 15 of the niche 14 just as the flared surface 9 couples partially with the corresponding surface 14, whilst the bottom level 12 of the container leans on the horizontal level 13 of the niche 14 with its area corresponding to niche 9; thus a stable superimposition of two or more full containers with a distance between their bottom levels is obtained in such a way that the lower bottom surface of a container does not touch the pizza 16 (FIG. 5). In the case of empty containers instead the niches are made to correspond with each other in order to obtain the arrangement of minimum encumberment in height. The operation of introducing a container into the full one below is facilitated by the existence of the peripheral level or step 5 which permits the bottom of the niches 9–10 to lean horizontally on it in order to fit more easily into the niches 13-14-15 after rotation. In the practical realization the material, the dimensions and the details of execution of the container can be different from those indicated but technically equivalent to them without leaving the juridical dominion of this invention for this reason. Thus, for instance, the bottom 1–12 can be equipped with ribs; moreover, two orders of niches like 13-14-15 on different levels might be foreseen in order to change the useful depth of the container. In that case the niches like 9 can fit into one or the other of the two orders of niches 14 angularly shifted between each other.

Further, the container could possibly present a square or rectangular or generally polygonal shape and the straight section of the niches could, moreover, be different from the shown C (or U) shape, that is of V or circle arc or any other shape. Finally the peripheral level of the step 5 might be omitted and therefore the niches 9–10 would be fitted into the niches 13-14-15 more difficult, because the horizontal reference formed by the level of the step 5 would be lacking.

I claim:

1. Container for the transport or storage of food, comprising:

a side wall shaped as a truncated cone or truncated pyramid with any chosen number of sides, growing narrower towards the bottom;

a bottom wall connected to the lower end of said side wall; and a projecting upper grip and stiffener rim extending from the top of said side wall, said rim having a peripheral edge;

wherein said side wall includes:

a small peripheral step therein below and inside of the upper level of said peripheral rim, said peripheral step protruding to the outside compared to the portion of said side wall therebelow;

a plurality of first niches therein interrupting said peripheral step at intervals of constant width, which first niches grow narrower towards the bottom, the walls of said first niches originating at the upper level of said rim and extending to said bottom wall, said first niche-walls projecting towards the outside compared to the portion of said side wall below said peripheral step; and a plurality of second niches therein, each said second niche being disposed at half the interval between successive ones of said first niches, the walls of each said niche originating at the level of said peripheral step and extending to a level above said bottom, wherein said second niches grow narrower toward the bottom and have a floor closing the bottom thereof, the level of said floor being at or above the level of the food anticipated to be carried by the container.

2. A container in accordance with claim 1, wherein the horizontal cross-section of said first and second niches is substantially the same, said first and second niches having dimensions such that the bottom of the walls of said first niches of one container can fit within the walls of said second niches of another container with the bottom of said first niches resting on the floor of said second niches.

3. A container in accordance with claims 1 or 2, wherein the angle of inclination from the vertical of said first niches is between approximately 4° and 20°.

4. A container in accordance with claims 1 or 2, wherein said side walls are of truncated cone shape with a substantially circular horizontal cross-section.

5. A container in accordance with claim 4, wherein the angular distance between each said first niche and adjacent said second niche is between 15° and 90°.

6. A container in accordance with claim 4, further including a lid comprising a disc of diameter substantially equal to the diameter of said side wall at the level of the floor of said second niches, said disc having a plurality of peripheral projections of shape suitable to fit into said second niches and rest on the floors thereof.

7. A container in accordance with claim 6, wherein said lid further has a plurality of peripheral projections of shape and location suitable to cover the section of said first niches.

8. A container in accordance with claim 1, further including a downwardly turned edge connected to the peripheral edge of said rim.

9. A container in accordance with claims 1 or 8, wherein said side wall further includes a peripheral bottom step near said bottom wall said bottom step being interrupted periodically.

* * * * *